US005320143A

United States Patent [19]

Hwang et al.

[11] Patent Number: 5,320,143

[45] Date of Patent: Jun. 14, 1994

[54] VARIABLE PITCH CYLINDRICAL CAM MECHANISM FOR CONTROLLING THE MOTION OF WEFT INSERTION MEMBERS IN SHUTTLELESS WEAVING LOOMS

[75] Inventors: Wen-Miin Hwang; Hong-Sen Yan; Rong-Shean Lee, all of Tainan, Taiwan

[73] Assignee: National Science Council, Taiwan

[21] Appl. No.: 929,520

[22] Filed: Aug. 14, 1992

[51] Int. Cl.[5] ..... D03D 47/18

[52] U.S. Cl. ..... 139/449; 74/59; 74/89.15

[58] Field of Search ..... 139/449; 74/59, 89.15, 74/58

[56] References Cited

U.S. PATENT DOCUMENTS 4,052,906 10/1977 Genini .
4,535,642 8/1985 Ohmura .
4,624,288 11/1986 Pezzoli ..... 139/449
5,033,516 7/1991 Debaes ..... 139/449

FOREIGN PATENT DOCUMENTS 61-295916 12/1986 Japan ..... 74/59

*Primary Examiner*—Andrew M. Falik
*Attorney, Agent, or Firm*—Michael D. Bednarek

[57] ABSTRACT

A mechanism controls the motion of the weft insertion member in shuttleless looms. This mechanism comprises a double-threaded variable pitch cylindrical cam and a slider having two pairs of frustoconical rollers. Each pair of frustoconical rollers is mounted on a thread of the variable pitch cylindrical cam. In operation, the cylindrical cam is able to rotate in a reciprocating manner by moving the slider in a rectilinear reciprocating manner. The mechanism is characterized in that the semi-conical angle of each frustoconical roller is formed such that the profile of the two threads of the variable pitch cam screw is easy to design and manufacture. In particular, the plane formed by the axes of each pair of frustoconical rollers is inclined at a predetermined angle in relation to the plane perpendicular to the axis of the variable pitch cylindrical cam and the predetermined angle is such that the thickness of each thread of the variable pitch cam screw is near constant, and uniform strength of each thread is obtained.

2 Claims, 7 Drawing Sheets

VARIABLE PITCH CYLINDRICAL CAM MECHANISM FOR CONTROLLING THE MOTION OF WEFT INSERTION MEMBERS IN SHUTTLELESS WEAVING LOOMS

FIELD OF THE INVENTION

The present invention relates to a mechanism which has a variable pitch cylindrical cam on which two pairs of cone-shaped rollers are engaged, and particularly to such a mechanism for use in shuttleless looms.

BACKGROUND OF THE INVENTION

Referring to FIG. 1, the conventional weaving loom primarily comprises a warp reel 1, a harness 2, a shuttle 3 a grill or reed 4 and a cloth roll 5. Ordinarily, woven fabric is produced by combining a plurality of warp yarns and a weft in a particular relation, such as in an interlacing relation. Normally, the plurality of warp yarns are divided into upper warp yarns 6*a* and lower warp yarns 6*b*. The upper warp yarn 6*a* and the lower warp yarns 6*b* are respectively held by an upper harness 2*a* and a lower harness 2*b* such that a shed is formed between the upper warp yarns 6*a* and the lower warp yarns 6*b*. In weaving operation, a weft-carrying insertion member, which is also known as a shuttle 3 (hereinafter "shuttle"), moves back and forth through the shed in a particular motion. Whenever the shuttle 3 completes a cycle, the grill (i.e., reed) 4, which acts as a comb, beats the weft to the right side to make the woven fabric dense and then returns to the left. A weaving loom of this kind is a so-called traditional weaving loom.

By contrast, a shuttleless weaving loom uses a weft-carrying gripper instead of a shuttle, for example, in the rapier weaving loom. Referring now to FIG. 2, a schematic diagram of a shuttleless weaving loom is shown. A weft-carrying gripper 30 and a weft-drawing gripper 31 are carried by a flexible strap 33 which is wrapped around a wheel 36. The wheel 36 ( for example, a belt wheel or gearwheel) is in turn driven by a driving mechanism 35. During weaving, the weft-carrying gripper 30 and weft-drawing gripper 31 move in a certain reciprocating motion, for example, in a more or less sinusoidal motion (also known as simple harmonic motion). To obtain such a motion, the driving mechanisms for the non-traditional weaving loom are mainly of three types: jet loom, gear and crank loom, and variable pitch cylindrical cam loom. Of the above three types of weaving machines, the variable pitch cylindrical cam loom is increasingly popular due to its high insertion rate of the weft end.

Genini U.S. Pat. No. 4,052,906, discloses a mechanism for controlling the motion of the weft-carrying grippers in looms. With reference to FIG. 3, the mechanism employs a cylindrical cam 29 with two pairs of cylindrical wheels 28 moving on each thread of the cam screw 29. In such a mechanism, the cylindrical cam 29 is hard to manufacture and machine. Furthermore, the cylindrical wheels 28 suffer serious wear at high insertion rates. See FIG. 4, wherein Ohmura, U.S. Pat. No. 4,535,642 is diagramatically shown. The traversing mechanism of Ohmura's patent is primarily composed of a cam shaft 41 and a cam shoe 40. The cam shoe 40 is mounted freely slidable on the helical cam groove of the cam shaft 41 for reciprocating a guide member 42. In such a traversing mechanism, the cam shoe 40 and the cam shaft 41 must be made of extremely hard material such as tungsten carbide. Pezzoli, U.S. Pat. No. 4,624,288, discloses a mechanism to control the movements of weft insertion members in shuttleless weaving looms as shown in FIG. 5. In such a mechanism, a rotary rectilinear motion of the gearwheel is achieved by a variable pitch cylindrical cam 44 with two pairs of sliding blocks 43 with an involute profile. The first drawback of such a mechanism is that the sliding blocks 43 are difficult to machine. The second drawback of such a mechanism is that the mating precision of the variable pitch cylindrical cam 44 and the sliding blocks 43 is relatively high. The third drawback of such a mechanism is the contact surface of the variable pitch cylindrical cam 44 and the sliding blocks 43 are worn out at high operation speeds. Eventually, the positioning accuracy of the weft-carrying gripper or the weft-drawing gripper deteriorates.

SUMMARY OF THE INVENTION

In order to overcome the above drawbacks, one of the objectives of the present invention is to provide a mechanism to control the motion of a weft insertion member in a shuttleless weaving loom. The mechanism of the present invention comprises a framework, a variable pitch double-threaded cylindrical cam, two pairs of frustoconical rollers, roller seats, and a slider. The mechanism, according to the present invention, is characterized in that during the rectilinear reciprocating motion of the weft-carrying gripper or the weft-drawing gripper caused by the rotary reciprocating motion of the variable pitch double-threaded cylindrical cam, the conjugate relation between the thread of the variable pitch cylindrical cam and said two pairs of frustoconical rollers is maintained at all times. Moreover, the plane containing the axes of each pair of frustoconical rollers is inclined at such an angle to the plane perpendicular to the axis of the cylindrical cam that the thickness of each thread of the cylindrical cam is almost constant and hence the strength of each thread of the cylindrical cam is also uniform. In particular, since the frustoconical rollers drivingly engage the cam screw, the space between the rollers must be equal to the thickness of the thread of the cam screw. Thus, by using frustoconical rollers and by inclining the rollers as claimed, it is possible to use a cam screw which has a constant thread thickness.

The cylindrical cam of the present invention has two opposite threads. Each pair of the frustoconical rollers are forced to be in immediate contact with each thread by a preload. Under the predetermined loading, any backlash that may exist between the cylindrical cam and these frustoconical rollers is thus eliminated. In other words, the accuracy of positioning of the weft-carrying gripper and the weft-drawing gripper is increased. Furthermore, since the load acting on the slider will be shared by four frustoconical rollers, the wear and fatigue of the contact surfaces of these frustoconical rollers and the cylindrical cam is lessened. One of the advantages of the present invention is that the shape of the frustoconical roller with simi-conical angle $\alpha$ is simple and is easy to manufacture. According to the principles of the present invention, the plane on which the axes of each pair of frustoconical rollers positioned is inclined at an angle $\beta$ to the plane perpendicular to the axis of the cylindrical cam. The thread profile of the cylindrical cam is generated by mating the profile of the frustoconical rollers based on a conjugate relation.

Therefore, the contact between the frustoconical rollers and the cylindrical cam is smooth. In particular, the uniform thickness of the two threads of the cylindrical cam is obtained by adjusting the angle $\beta$ according to the present invention so that the irregular thickness of the variable pitch cylindrical cam in the prior art is eliminated. Consequently, the strength of the two threads of the variable pitch cylindrical cam is increased.

BRIEF DESCRIPTION OF THE DRAWINGS

Other objectives and advantages of the present invention will become clear from the following description with reference to the accompanying drawings, wherein.

DETAILED DESCRIPTION OF THE INVENTION

Figure 1:
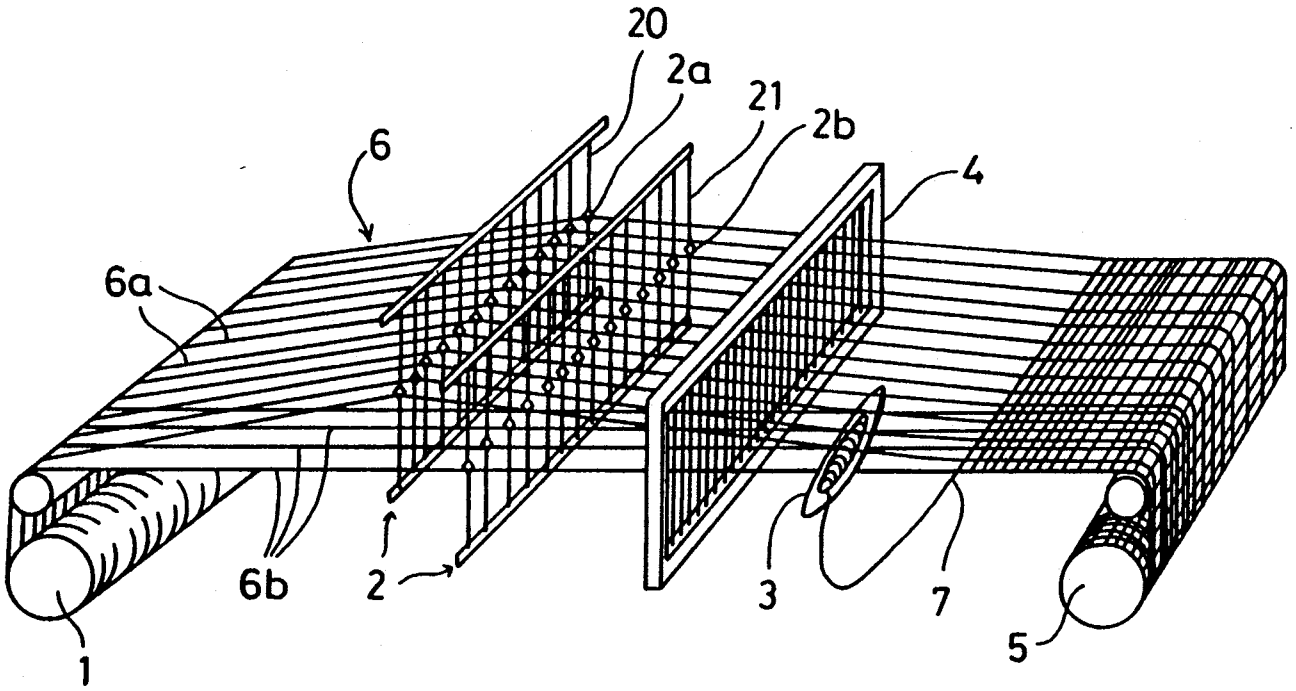
FIG. 1 is a schematic view of a traditional weaving loom with shuttle.
Figure 2:
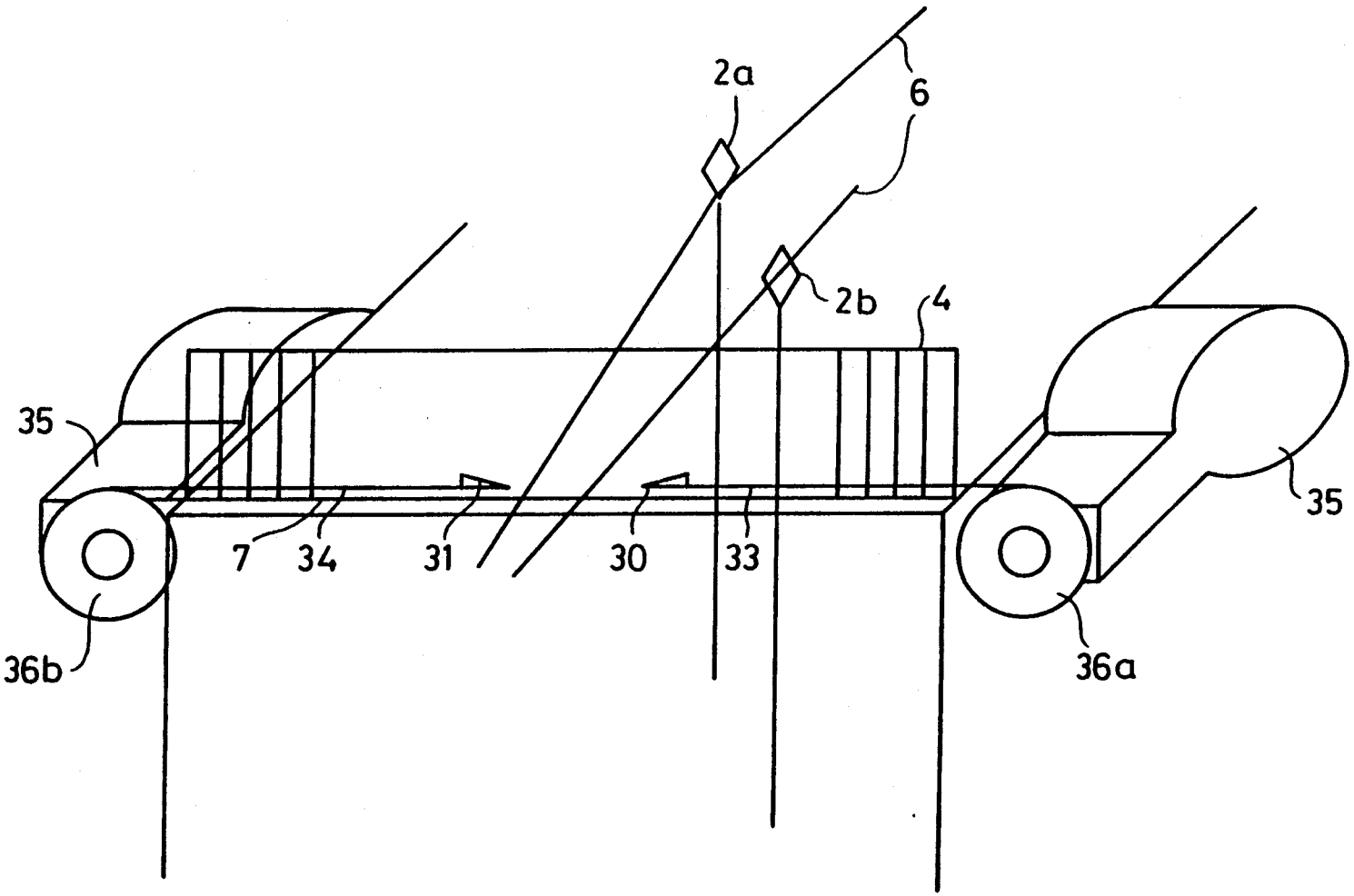
FIG. 2 is a schematic view of a rapier weaving loom.
Figure 3:
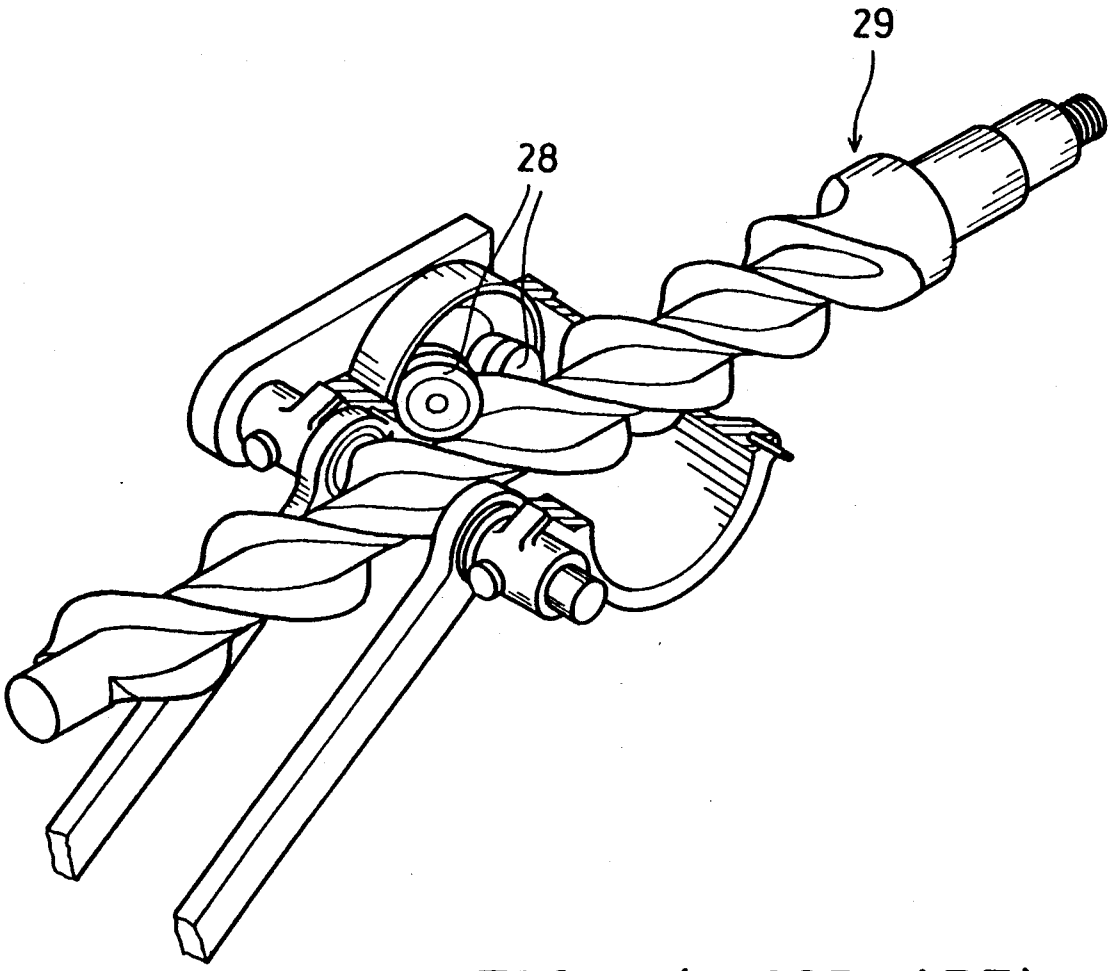
FIG. 3 (PRIOR ART)
FIG. 3 is a schematic view of the conventional mechanism for controlling the motion of the weft carrying grippers in looms.
Figure 4:
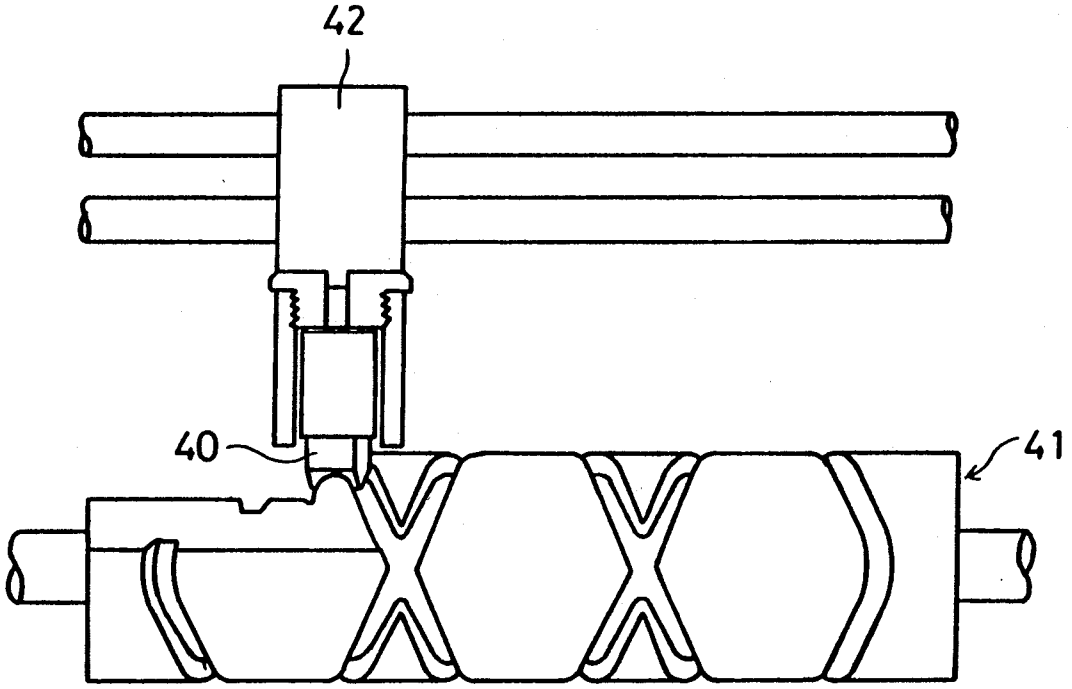
FIG. 4 (PRIOR ART)
FIG. 4 is a plane view of the conventional traversing mechanism.
Figure 5:
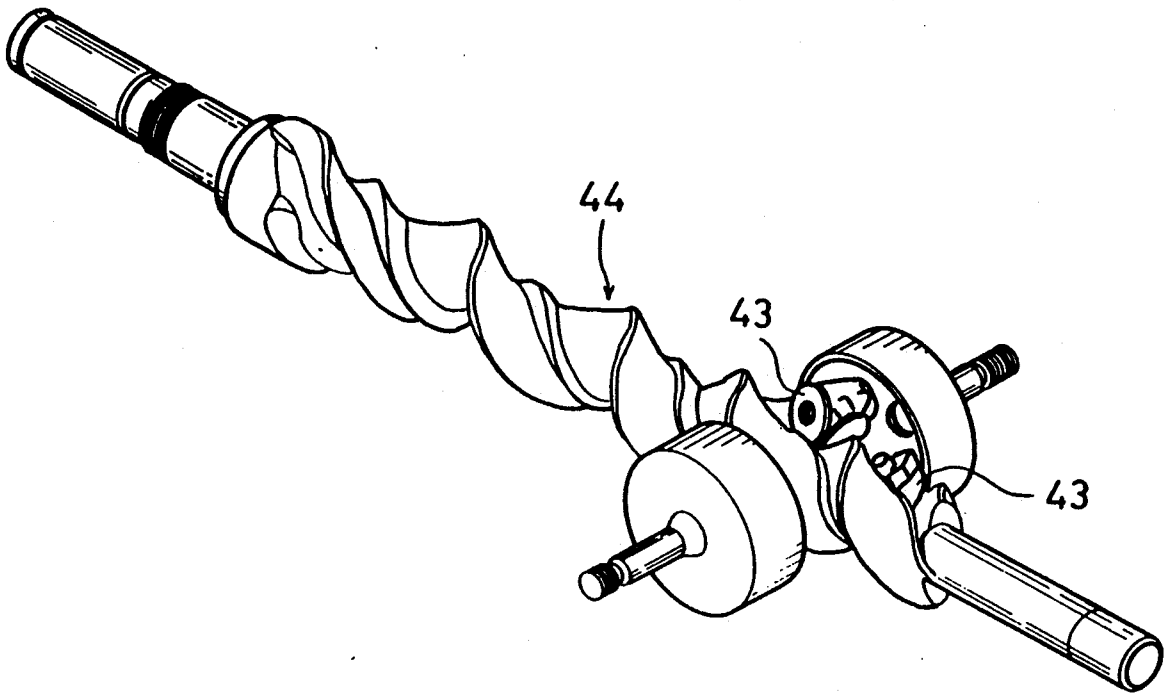
FIG. 5 (PRIOR ART)
FIG. 5 is a schematic view of the conventional mechanism to control the movements of weft insertion members in shuttleless weaving looms.
Figure 6:
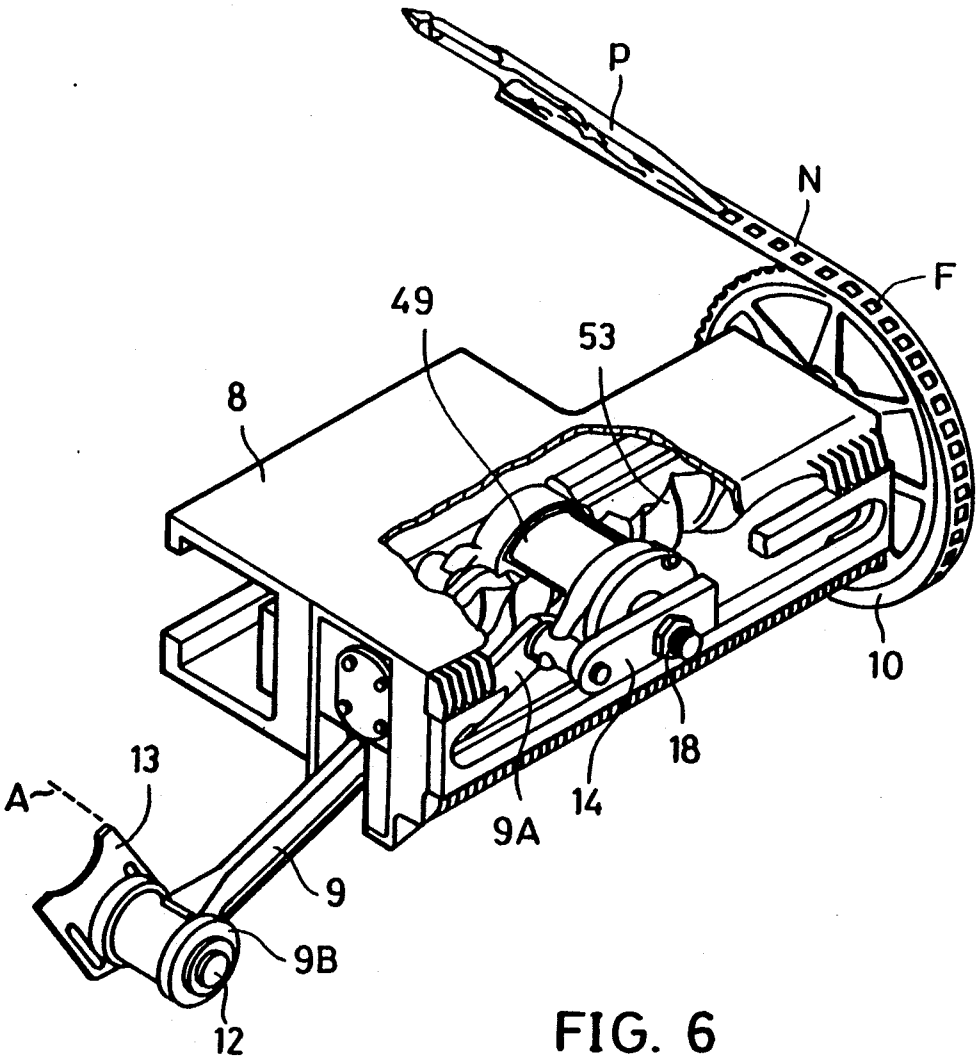
FIG. 6 is an assembly perspective view of the mechanism according to the present invention.

The mechanism for controlling the forward movement of the grippers P in a weaving loom (not shown) with continuous weft feed, is similar to that disclosed in U.S. Pat. No. 4,624,288. With reference to FIG. 6 the mechanism comprises a stout metal framework 8 containing mechanical members adapted to convert a rectilinear reciprocating motion into a rotary motion (for instance, the small end of a connecting rod 9 or, alternatively, a cam transmission operating said members) and a gearwheel 10, to which oscillation is imparted by said members and the teeth 11 of the gearwheel, engaging the slits F of the strap N controlling the gripper P, produce the motion of said strap. The connecting rod has its small end 9A adapted to perform merely a reciprocating motion along a rectilinear path, while its big end 9B is engaged on a crank which forms with the connecting rod 9 a connecting rod-crank unit. The crank (not shown) with the slide 13 rotates about a shaft A (the axis of which is indicated in FIG. 6 by dashed lines), which can either be the main shaft of the weaving loom or else a secondary shaft rotating at the same speed as the main one. Alternative to the connecting rod-crank unit, the loom shaft may control cam transmission. The position of the slide 13 may be radially changed on the crank so as to vary the eccentricity of the crank mechanism, thus realized, in respect to the shaft A. This serves to adjust the length of the stroke of the connecting rod 9, and hence that of the gearwheel 10 and that of the gripper P. The position of the slide 13 is set with the loom at a stop, by any known mechanical means.

According to the present invention, the members for converting the rectilinear reciprocating motion of the small end 9A of the connecting rod 9 into an oscillation of the gearwheel 10 essentially comprise, along with the framework 8: a cylindrical cam 53, having one end keyed to the gearwheel 10 and the other end mounted freely rotatable; a slider 49, traversed by said cylindrical cam 53 and moved by the action of the connecting rod 9 and slidable in guides of the framework 8, parallel to the cylindrical cam 53; and two pairs of frustoconical rollers (50*a*,50*b*) and (50*c*,50*d*), carried by said slider 49 and adapted to establish an engagement between the slider 49 and the threads 51 and 52 of the cylindrical cam 53, causing the rotation of said cylindrical cam 53 when the slider 49 moves along its own rectilinear path.

In dealing with a mechanism consisting of bodies in rolling contact, no slippage between the bodies is allowed. Otherwise the mechanism will not operate quietly and with very low friction loss. In order for two rolling bodies to maintain a constant angular velocity ratio, they must satisfy the following fundamental laws: (1). they must have common points of contact; (2). they must have a common normal passing through the point of contact at all times; (3) the relative velocity component of the point of contact in the direction perpendicular to the normal must be zero. When two rolling bodies satisfy the above fundamental law, the rolling bodies are said to produce conjugate action. If the foregoing fundamental laws are met, the quiet and vibrationless operation of said two rolling bodies is assured. Consequently, the wear on the two contact surfaces of the rolling bodies will be reduced.

Figure 7:
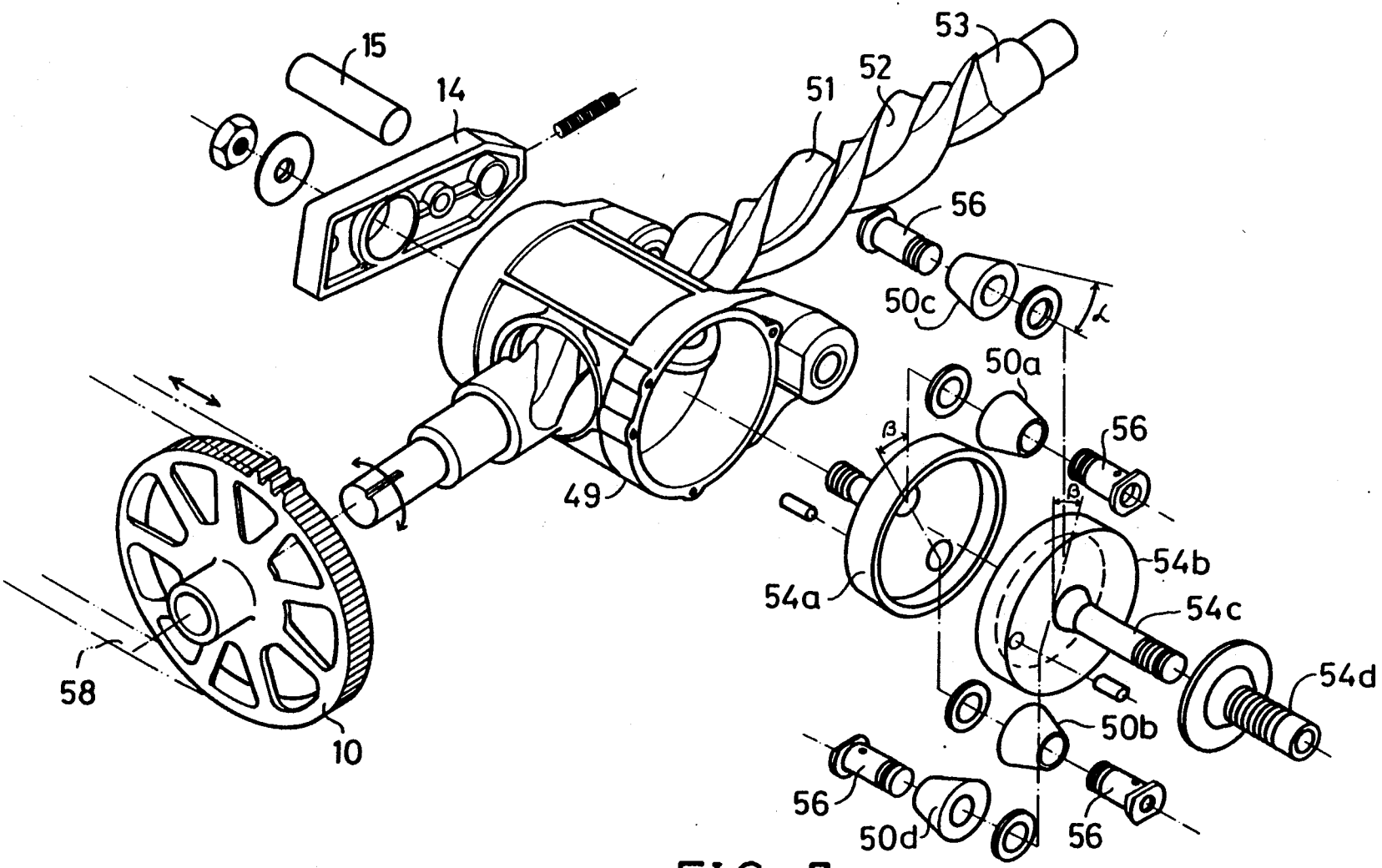
FIG. 7 is a schematic view of the mechanism for controlling the motion of the weft insertion in a shuttleless loom according to the present invention.

According to the above fundamental laws, the present invention provides an improved mechanism over prior inventions. With reference to FIG. 7, the weft insertion is performed by two pairs of frustoconical rollers (50*a*, 50*b*) (50*c*, 50*d*) engaged in opposed pairs, wherein a bore is integrally formed in each frustoconical roller with a suitable semi-conical angle $\alpha$ and by a variable pitch double-threaded cylindrical cam 53. The frustoconical rollers (50*a*, 50*b*, 50*c*, 50*d*) are secured respectively to roller seats (54*a*, 54*b*) by passing the shafts 56 through the bore of the frustoconical rollers (50*a*, 50*b*, 50*c*, 50*d*). Meanwhile, the roller seats (54*a*, 54*b*) are secured to the slider 49 by the screws 54*c* and 54*d*. The four frustoconical rollers (50*a*, 50*b*, 50*c*, 50*d*) are divided into two pairs of frustoconical rollers, (50*a*, 50*b*) and (50*c*, 50*d*) each in strictly mating engagement with the threads 51 and 52 of the cylindrical cam 53, for example by compression springs (not shown). The imaginary plane on which each pair of the frustoconical rollers positioned is inclined at an angle $\beta$ with the plane perpendicular to the axis of the cylindrical cam 53. The angle formed between the two imaginary planes is $2\beta$. As long as a driving force is transmitted to the slider 49, the slider 49 will move in a rectilinear reciprocating motion along the axis of the variable pitch cylindrical cam 53. Subsequently, the variable pitch cylindrical cam 53 is forced to rotate along its axis. In this manner, the gearwheel 57 is rotated forwards and backwards. Eventually, the rectilinear reciprocating motion of the strap 58, to which a weft-carrying gripper or a weft-drawing gripper is secured, is obtained.

While the invention has been described by way of examples and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A mechanism for controlling the motion of a weft insertion member in shuttleless weaving looms, comprising:

a double-threaded variable pitch cylindrical cam, which is adapted to be secured to the weft insertion member; and a slider, which has two pairs of frustoconical rollers by which the slider is drivingly engaged to a double-threaded variable pitch cam screw with each pair of the frustoconical rollers engaged on each thread of the double-threaded variable pitch cylinder cam, each roller having an angle of inclination formed such that the profile of each thread of the variable pitch cylindrical cam is in a conjugate relation with the surface of each pair of the frustoconical rollers to obtain smooth transmission from rectilinear reciprocating motion of the slider to rotary reciprocating motion of the variable pitch cylindrical cam.

2. A mechanism as claimed in claim 1, wherein the plane formed by the axes of each pair of frustoconical rollers is inclined at a predetermined angle with respect to the plane perpendicular to the axis of the variable pitch cylindrical cam and the angle of inclination is such that the thickness of each thread of the variable pitch cam screw is near constant so as to obtain a uniform strength of each thread.

* * * * *